US005590823A

United States Patent [19]

Lunde

[11] Patent Number: 5,590,823

[45] Date of Patent: Jan. 7, 1997

[54] COLLAPSIBLE GARMENT HANGER SUITABLE FOR RAPID ONE-HANDED ENGAGEMENT WITH GARMENT

[75] Inventor: Mark H. Lunde, El Cajon, Calif.

[73] Assignee: Donald J. Ersler, Brookfield, Wis.

[21] Appl. No.: 403,644

[22] Filed: Mar. 14, 1995

Related U.S. Application Data

[63] Continuation-in-part of Ser. No. 269,541, Jul. 1, 1994, abandoned.

[51] Int. Cl.[6] ..... A41D 27/22; B25G 3/28

[52] U.S. Cl. ..... 223/94; 223/85; 403/353

[58] Field of Search ..... 223/85, 89, 88, 223/92, 94; 403/353, 360; D6/324

[56] References Cited

U.S. PATENT DOCUMENTS

| | | | |
|---|---|---|---|
| 1,184,288 | 5/1916 | Wesner . | |
| 1,676,936 | 7/1928 | Trevino | 223/94 |
| 2,137,700 | 11/1938 | Reehl | 223/94 |
| 2,290,722 | 7/1942 | Weingarter | 223/94 |
| 2,595,442 | 5/1952 | Basnes | 223/29 |
| 2,728,499 | 12/1955 | Mueller | 223/94 |
| 2,926,823 | 3/1960 | Weiser | 223/94 |
| 3,531,028 | 9/1970 | Vazquez | 223/94 |
| 3,645,426 | 2/1972 | Glascock et al. | 223/89 |
| 4,009,507 | 3/1977 | Lascarrou | 403/353 |
| 4,225,265 | 9/1980 | Hooker et al. | 403/353 |
| 4,227,632 | 10/1980 | Collis | 223/94 |
| 4,813,581 | 3/1989 | LaMont | 223/94 |

FOREIGN PATENT DOCUMENTS

| | | | |
|---|---|---|---|
| 2050732 | 8/1980 | Germany | 223/94 |

OTHER PUBLICATIONS

Advertisement For "Pop Hanger," Inventor: Michael E. Adams, Photocopy Attached.

*Primary Examiner*—John J. Calvert
*Assistant Examiner*—Bibhu Mohanty
*Attorney, Agent, or Firm*—Donald J. Ersler

[57] ABSTRACT

A collapsible garment hanger which includes a hook, a first and second tensioning element which extend from the hook, the first and second tensioning elements being terminated with a first and second distal tip, respectively. A first and second shoulder element each having a first end and a substantial middle region, the first ends of the first and second shoulder elements being pivotally connected and rotate in relation to each other, the substantially middle region of the first and second shoulder elements having a hole which accepts the first and second distal tips, respectively. The first and second shoulder elements pivot in relation to the first and second tensioning elements, respectively. The first and second tensioning elements are grasped and compressed toward each other with one hand to force the first and second shoulder elements into a collapsed position for insertion or removal from a small opening in a garment. An alternative preferred embodiment connects the first ends of the first and second shoulder elements with a sliding tip and slot instead of a pivot to allow support of a heavier garment.

4 Claims, 2 Drawing Sheets

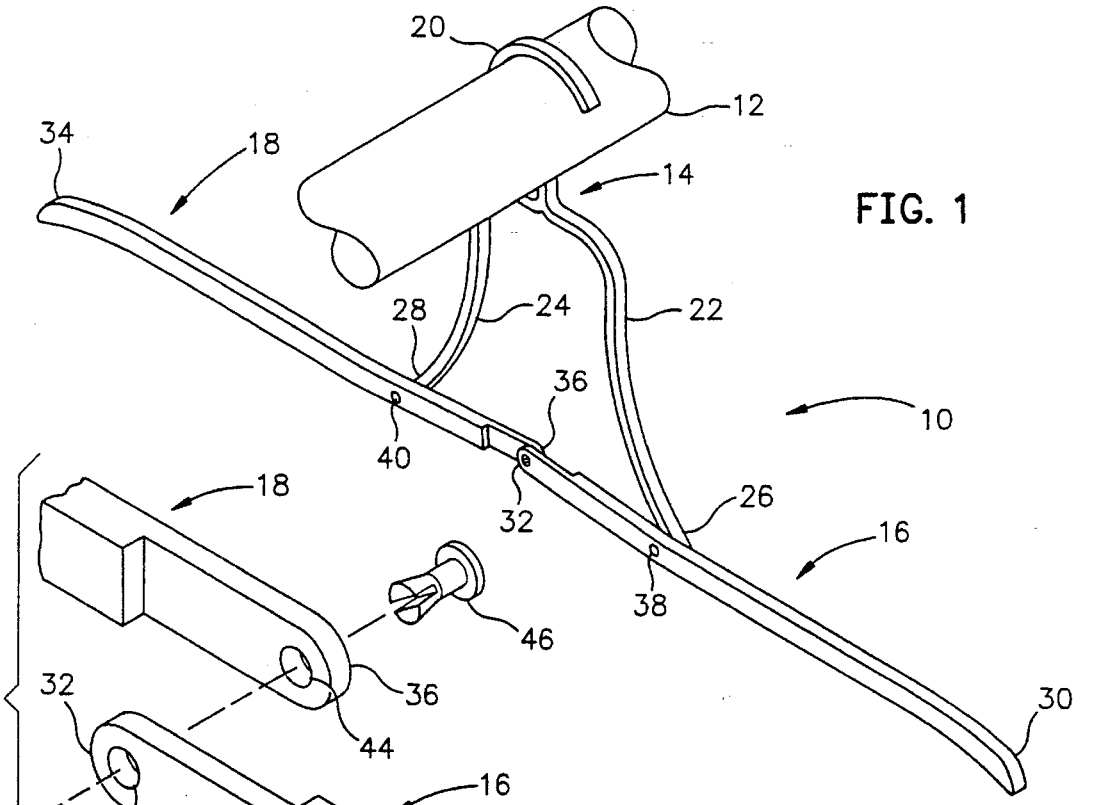
FIG. 1
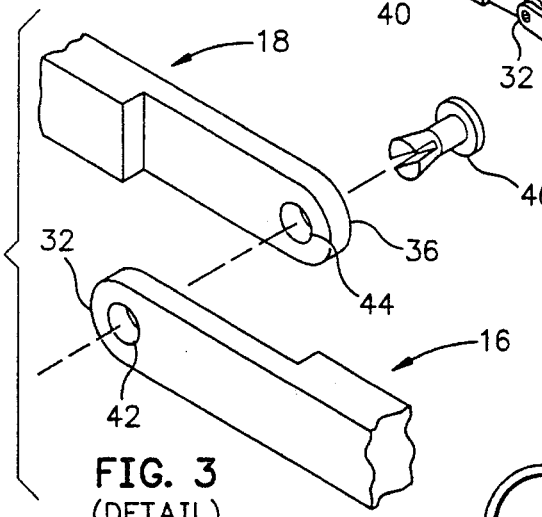
FIG. 3
(DETAIL)
FIG. 4
(DETAIL)
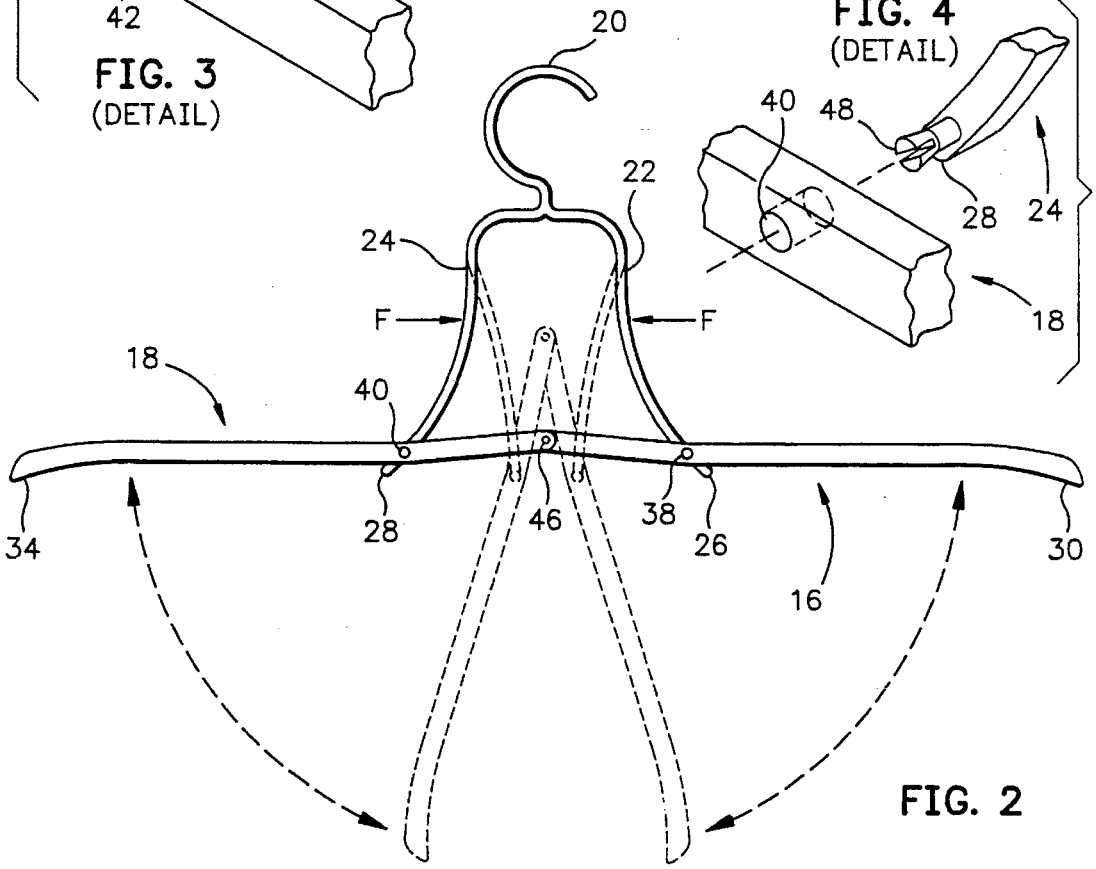
FIG. 2

COLLAPSIBLE GARMENT HANGER SUITABLE FOR RAPID ONE-HANDED ENGAGEMENT WITH GARMENT

This application is a continuation-in-part of Ser. No. 08/269,541, filed Jul. 1, 1994, now abandoned.

BACKGROUND OF THE INVENTION

1. Field of the Invention

This invention relates generally to collapsible garment hangers and specifically to a thermoplastic resin folding hanger suited for rapid one-handed insertion into and removal from a small garment opening.

2. Discussion of the Related Art

The collapsible garment hanger art has a long and proliferous history. Numerous practitioners in the art have suggested many improvements to the common garment hanger over the years. Many of these successive improvements arise from exploitation of the properties of new materials previously unknown in the garment hanger art. Most such improvements arise from a clearly-felt need in the art for convenience and compactness. The following discussion samples the progress of collapsible garment hanger art over the past century.

In U.S. Pat. No. 1,184,288, F. W. Wesner discloses an automatic folding hanger having a pair of garment supporting arms shiftable from supporting position to relatively collapsed position by means of manual operation of a heavy metallic spring member. Wesner teaches the use of a wire hanger with arms that are connected indirectly to the metallic spring using a slide and cam technique. Unfortunately, the design as shown in the patent cannot be operated with mere hand pressure, the force required to collapse the spring is too great. Further, Wesner neither considers nor suggests any suitable nonmetallic material for implementing his automatic folding hanger.

In U.K. Patent 149,108, J. T. Tilley discloses an improved coat hanger having two separate shoulder pieces permanently hinged at their inner ends to one another and to the lower end of a suspension hook so that the shoulder pieces swing upwardly for folding the hanger and downwardly onto and against supporting abutments when the hanger is in use. Tilley's hanger collapses only for storage and is not suited for rapid insertion into and removal from a garment. Because the shoulder pieces swing upwardly when folded, his hanger cannot change positions while engaged with the garment.

In U.K. Patent 201,798, J. W. H. Dew discloses a clothes-hanger having a bowed or triangular formation with several hinged members that are folded together when not in use. Like Tilley, Dew neither considers nor suggests means for quick insertion and removal of his hanger. Dew's hanger cannot be reconfigured while engaging a garment and is merely a hanger capable of being folded compactly when not supporting a garment.

In U.S. Pat. No. 1,676,936, D. R. Trevino discloses a garment hanger designed to fold in a neat and compact manner for packing in luggage or the like. Trevino uses a metallic Y-form neck element to couple a pair of nonmetallic shoulder members hingedly connected at their inner ends and adapted to bear against each other above the hinge point. Trevino neither considers nor suggests means for one-handed operation and provides no mechanical biasing means to force the hanger into deployment after insertion into a garment.

In U.S. Pat. No. 2,137,700, F. W. Reehl discloses a garment hanger with two pivoted arms under the control of a tensioner that tends to spread the arms from a partially closed or collapsed position into a garment supporting position. Reehl's tensioner acts to collapse the arms when pressure is applied thereto. Reehl neither considers nor suggests nonmetallic spring tension means and his hanger requires two hands to operate, primarily because a pin must be inserted to retain the garment supporting position. Further, extraction of the pin must be done blindly because material of a garment obscures visual location of the pin.

In U.S. Pat. No. 3,531,028, F. B. Vazquez discloses a nonmetallic collapsible clothes hanger of unitary construction having arms that may be flexed to an unfolded position for use or to a folded position for storage. Vazquez's hanger requires two hands to deploy and includes no tensioning means for automatic deployment to a garment supporting position after insertion into a garment. He neither considers nor suggests such applications. Moreover, Vazquez teaches the use of remarkably complex pinning and latching elements in his injection-molded design, which uses improvements made in nonmetallic materials technology recently preceding issuance of his patent.

In U.S. Pat. No. 4,227,632, J. H. Collis discloses a flexible garment hanger formed of a one-pieced, molded plastic-like material with several flexible hinges. His design includes a locking bar below the body of the hanger secured to both arms by means of similar flexible hinges and a stop member projecting medially from the locking bar with two additional flexible hinges. Collis' hanger requires two hands to operate and provides no means for automatic restoration of a garment supporting position upon insertion into a garment. Collis' invention uses the recently preceding improvements in plastic molding and materials technology that allow feasible plastic hinges and is otherwise merely an improved garment hanger that can be collapsed for storage.

In U.S. Pat. No. 4,813,581, R. M. LaMont discloses a unitary collapsible hanger formed of plastic that includes hanger arms attached to a hook by plastic hinges. LaMont includes a nonmetallic C-shaped spring element made possible by recently preceding improvements in injection-molded plastic materials technology. When LaMont's hanger is collapsed, the spring is in its relaxed configuration and the center hinge is disposed below the spring hinges. When his hanger is in the garment supporting position, the center hinge is above the spring hinges and engages a stop member so that bearing surfaces engage shoulders of the stop member to lock the hanger in its garment supporting position. Thus, although LaMont employs a plastic spring, his spring does not act to force the hanger into a garment supporting position following insertion into a garment, but merely operates as a lock tensioning means for holding the hanger in the garment supporting position.

Accordingly, there is still a clearly-felt need in the art for a simple, inexpensive, nonmetallic (rust-free) garment hanger that can be collapsed with one-hand for insertion into or removal from a garment and which automatically springs into the garment supporting position upon release. Such hanger should be suitable for use with small garment openings and should automatically adopt a garment supporting position after insertion into a garment. These unresolved problems and deficiencies are clearly felt in the art and are solved by our invention in the manner described below.

SUMMARY OF THE INVENTION

Our invention solves the above problems by providing a collapsible garment hanger formed of three thermoplastic parts adapted for one-handed insertion into and removal from a small garment opening. One of the parts includes a hook for hanging on a wardrobe dowel, a first and second tensioning element that can be grasped and compressed with one hand to force a first and second shoulder element into a collapsed position for insertion or removal from a garment. The preferred embodiment uses a nonmetallic thermoplastic resin that retains sufficient spring tension over many cycles to hold the hanger in a garment supporting position without locking pins or support brackets.

It is an object of this invention to provide a hanger permitting one-handed operation to free the other hand for garment positioning, thereby speeding the garment-handling process. It is an advantage of this invention that the tensioning frame may be grasped and compressed with one hand, and that the hanger automatically springs back from the collapsed position to the garment supporting position when tensioning force is removed from the tensioning frame.

It is another object of this invention to provide a hanger that operates in any position without relying on gravitation to initiate the collapsing motion of the shoulder elements. It is an advantage of this invention that a three-point hinging scheme be used that does not rely on gravitation to initiate collapse of the shoulder elements.

It is another object of this invention that no metal elements are required because one of several thermoplastic resins can be used for the necessary tensioning frame.

It is yet another object of this invention to provide a collapsible garment hanger that can be produced inexpensively. It is an advantage of the hanger of this invention that three parts and a self locking pin are sufficient for creating a preferred embodiment.

Finally, it is another object of this invention to provide an alternative preferred embodiment to connect the first and second shoulder elements together with a sliding tip and slot. The substitution of the sliding tip and slot in place of a hinging scheme allow support of a heavier garment by the invention.

The foregoing, together with other objects, features and advantages of our invention, will become more apparent when referring to the following specification, claims and accompanying drawings.

BRIEF DESCRIPTION OF THE DRAWING

For a complete understanding of our invention, we now refer to the following detailed description of the embodiment as illustrated in the accompanying drawing wherein:

FIG. 1 shows a perspective view of a preferred embodiment of the collapsible garment hanger according to this invention in the garment supporting position;

FIG. 2 shows a front view of the preferred hanger embodiment in the garment supporting position and a collapsed position;

FIG. 3 shows a perspective exploded detail view of the preferred embodiment for rotatably coupling the first and second shoulder elements;

FIG. 4 shows a perspective exploded detail view for rotatably coupling the second shoulder element to the second tensioning element for the preferred embodiment;

DETAILED DESCRIPTION OF THE PREFERRED EMBODIMENT

Figure 5:
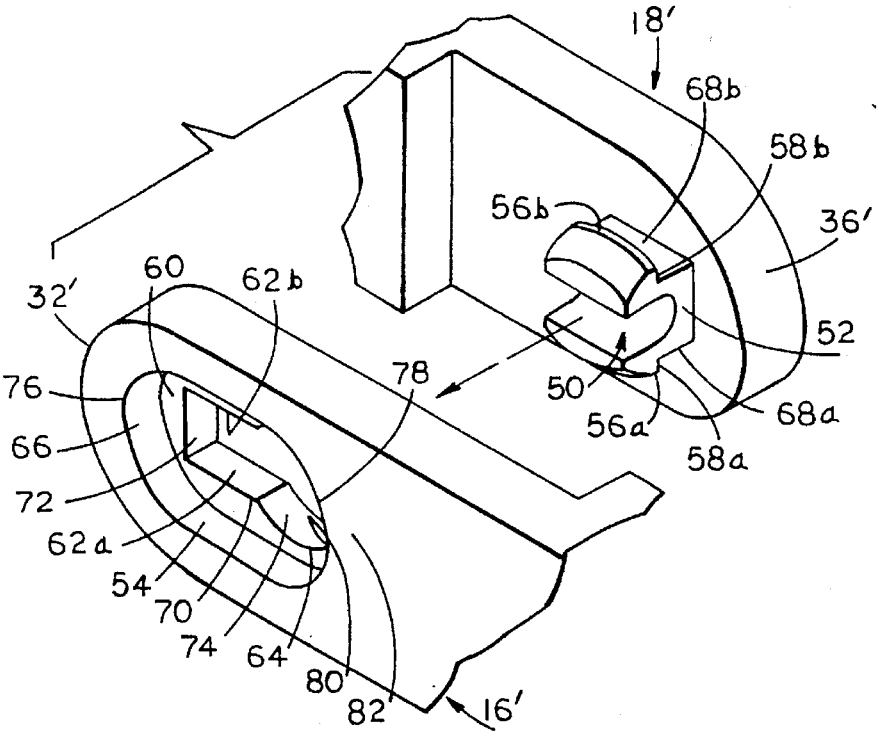
FIG. 5 shows a perspective exploded detail view of the alternative preferred embodiment for coupling the first ends of the first and second shoulder elements.

FIG. 1 shows a preferred embodiment of the collapsible garment hanger 10 of our invention disposed on a wardrobe dowel bar 12. Tensioning frame 14 includes a hook 20, a first tensioning element 22 and a second tensioning element 24 which are connected with hook 20. First tensioning element 22 extends from hook 20 in a common plane and is terminated with a first distal tip 26. Similarly, second tensioning element 24 also extends from hook 20 in a common plane and is terminated with a second distal tip 28.

First shoulder element 16 and second shoulder element 18 are identical shoulder elements. First shoulder element 16 includes a first end 32, a second end 30, and a substantially middle region which is disposed between first end 32 and second end 30. A hole 38 is located in the substantially middle region. Second shoulder element 18 includes a first end 36, a second end 34, and a substantially middle region which is disposed between first end 36 and second end 34. A hole 40 is located in the substantially middle region.

FIG. 3 shows first shoulder element 16 with a hole 42 at first end 32, and second shoulder element 18 with a hole 44 at first end 36. First shoulder element 16 and second shoulder element 18 are rotatably joined by passing a retaining pin 46 through hole 42 and hole 44.

FIG. 2 shows the vertical distance between pin 46 and hook 20 as defined by the small letter "d." The large letter "D" defines the vertical distance between hole 38 and hook 20 or hole 40 and hook 20 when the invention is in the garment supporting position. The vertical distance between pin 46 and hook 20 is less than the vertical distance between hole 38 and hook 20 or hole 40 and hook 20. The vertical positioning of pin 46 and holes 38 and 40 is critical for ensuring that the first and second shoulder elements 16 and 18 will rotate downward responsive to the application of force to first and second tensioning elements 22 and 24.

The invention will assume the garment supporting position before force is applied to first and second tensioning elements 22 and 24. The invention will also assume the garment supporting position after force is removed from first and second tensioning elements 22 and 24. With the location of pin 46 and holes 38 and 40, the user need not rely on gravity to ensure downward rotation, as was commonly required in the prior art. Moreover, the spring tension of first and second tensioning elements 22 and 24 is sufficient to support the weight of the garment on first and second shoulder elements 16 and 18. The spring tension in the first and second tensioning elements 22 and 24 is achieved by the use of a thermoplastic resin. We prefer polypropylene for tensioning frame 14 and have found that a symmetric 0.53 centimeter square cross-section is sufficient to ensure the necessary tensioning and support properties of the first and second tensioning elements 22 and 24. Other thermoplastic resins with equivalent properties may also be usefully employed in tensioning frame 14.

FIG. 4 shows the preferred embodiment for rotatably coupling first and second distal tips 26 and 28 to holes 38 and 40 in first and second shoulder elements 16 and 18, respectively. As an example, FIG. 4 shows second distal tip 28 extending from second tensioning element 24 and its relationship to hole 40 in the substantially middle region of shoulder element 18. Notched protrusion 48 is forcibly slipped through hole 40 to retain second shoulder element 18 rotatably against second distal tip 28 and must be sized to permit unrestrained rotation. Thermoplastic resin material may also be used to fabricate first and second shoulder elements 16 and 18, we prefer polypropylene or the equivalent.

Thus as shown in FIGS. 1 and 2, we have described a collapsible hanger including tensioning frame 14, first shoulder element 16 and second shoulder elements 18. First shoulder element 16 and second shoulder element 18 may be rotatably coupled together with pin 46 (FIG. 3) or any other suitable means known in the art. We prefer the shoulder coupling structure illustrated in FIG. 3 because this permits both first shoulder element 16 and second shoulder element 18 to be made with a single mold. Of course, by using two molds for first shoulder element 16 and second shoulder element 18, one may be molded with a hole and the other with a notched protrusion to permit rotatable coupling in the manner illustrated in FIG. 4.

FIG. 5 shows an alternative structure for coupling the first ends 32' and 36' of first shoulder element 16' and second shoulder element 18', respectively. Slidable tip 52 extends from second shoulder element 18' at first end 36'. Slidable tip 52 has two parallel surfaces **68*a* & 68*b* extending from the first end 36' of second shoulder element 18'. A notched protrusion 50 is formed as an integral part of sliding tip 52. Radial surfaces 56*a* and 56*b* are located on the outside periphery of notched protrusion 50. Mating surfaces 58*a* and 58*b* are located perpendicular to radial surfaces 56*a* and 56*b*, respectively. Slot 70 extends through the width of shoulder element 16' at first end 32' thereof. Slot 70 has two parallel surfaces 62*a* & 62*b* at a first end 72 thereof. Parallel surfaces 62*a* & 62*b* extend to a second end 74 and slot 70 is terminated with a hole 64 at second end 74. Material is removed to form a countersunk slot 54 with a bottom surface 60 located between a first end 76 and a second end 78 in a front surface 82 of first shoulder element 16'. A first radial surface 66 is located at the first end 76 of countersunk slot 54. A second radial surface 80 is located at the second end 78 of countersunk slot 54. Bottom surface 60 is located between the first end 76 and second end 78 of the countersunk slot 54 and bottom surface 60 is perpendicular to first and second radial surfaces 66 and 80**.

First shoulder element 16' and second shoulder element 18' are coupled by forcing slidable tip 52 through hole 64. Mating surfaces **58*a* & 58*b* of notched protrusion 50 and bottom surface 60 retain second shoulder element 18' against first shoulder element 16'**.

Figure 6:
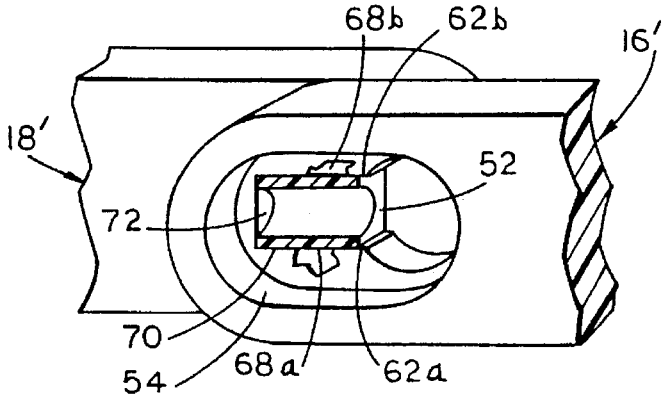
FIG. 6 shows a perspective detail view of the alternative preferred embodiment of the first and second shoulder elements assembled in the first position.

FIG. 6 shows first shoulder element 16', second shoulder element 18' and sliding tip 52 with part of the notched protrusion 50 removed to reveal parallel surfaces **68*a* & 68*b* in a first position. When garment hanger 10 is in the first position (garment supporting position) as analogously shown in FIG. 1, parallel surfaces 68*a* and 68*b* slidably fit against parallel surfaces 62*a* and 62*b***, respectively.

Figure 7:
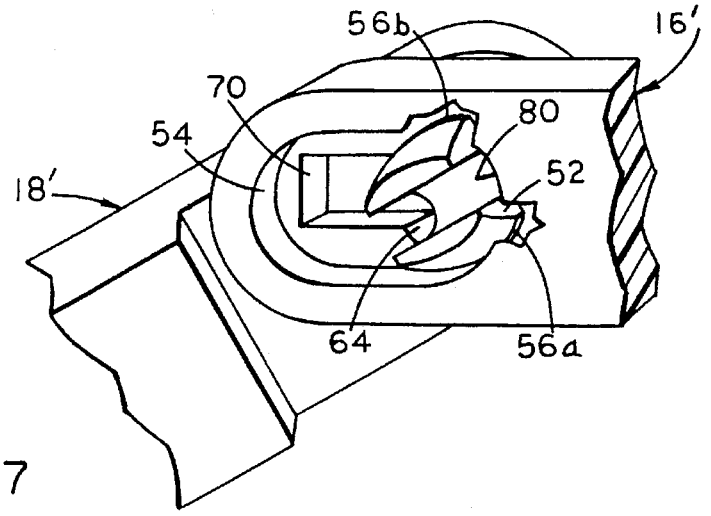
FIG. 7 shows a perspective detail view of the alternative preferred embodiment of the first and second shoulder elements assembled in the second position.

FIG. 7 shows first and second shoulder elements 16' and 18' located in a second position and partially rotated in relation to each other. When first and second tensioning elements 22 and 24 shown in FIG. 1 are depressed, first shoulder element 16' and second shoulder element 18' move horizontally in relation to each other from the first position until radial surfaces **56*a* and 56*b* contact second radial surface 80 in the second position. When more pressure is applied to first and second tensioning elements 22 and 24 shown in FIG. 1, slidable tip 52 rotates within hole 64, first shoulder element 16' and second shoulder element 18' also rotate in relation to each other as also shown in FIG. 2**.

The alternative preferred embodiment for coupling the first and second shoulder elements has the advantage of allowing support of a heavier garment while making the garment hanger stronger in the garment supporting position.

Other embodiments and modifications of our invention may occur readily to those of ordinary skill in the art in view of these teachings. Therefore, our invention is to be limited only by the following claims, which include all such embodiments and modifications when viewed in conjunction with the above specification and accompanying drawing.

I claim:

1. A garment hanger comprising:

a hook;

a first tensioning element extending from said hook, said first tensioning element and said hook lying in a common plane, said first tensioning element terminating in a first distal tip;

a second tensioning element extending from said hook, said second tensioning element and said hook lying in a common plane, said second tensioning element terminating in a second distal tip;

a first shoulder element having a first end and a second end, a substantially middle region of said first shoulder element being located between said first end and said second end thereof, said substantially middle region having a hole located therein, said first shoulder element having said first end terminating in a slot, said slot having a first end and a second end, said first end of said slot having mutually parallel surfaces which extend into said second end, said second end having a hole which communicates with said slot;

said first shoulder element having a front surface;

a countersunk slot which is located in said front surface at said first end of said first shoulder element, said countersunk slot having a first end and a second end;

a first radial surface which is located at said first end of said countersunk slot;

a second radial surface which is located at said second end of said countersunk slot;

a bottom surface located between said first end and said second end of said countersunk slot, said bottom surface being perpendicular to said first and second radial surfaces of said countersunk slot;

a second shoulder element having a first end and a second end, a substantially middle region of said second shoulder element being located between said first end and said second end thereof, said substantially middle region having a hole located therein; and wherein said first distal tip of said first tensioning element is rotatably connected to said first shoulder element at said hole therein, said second distal tip of said second tensioning element is rotatably connected to said second shoulder element at said hole therein.

2. The garment hanger of claim 1, wherein vertical distance between said slot and said hook is less than vertical distance between said first distal tip and said hook, vertical distance between said slot and said hook is less than vertical distance between said second distal tip and said hook, wherein said first shoulder element and said second shoulder element rotate downward responsive to a deflection of said first and second tensioning elements mutually toward each other.

3. A garment hanger comprising:

a hook;

a first tensioning element extending from said hook, said first tensioning element and said hook lying in a common plane, said first tensioning element terminating in a first distal tip;

a second tensioning element extending from said hook, said second tensioning element and said hook lying in a common plane, said second tensioning element terminating in a second distal tip;

a first shoulder element having a first end and a second end, a substantially middle region of said first shoulder element being located between said first end and said second end thereof, said substantially middle region having a hole located therein, said first shoulder element having said first end terminating in a slot, said slot having a first end and a second end, said first end of said slot having mutually parallel surfaces which extend into said second end, said second end having a hole which communicates with said slot;

said first shoulder element having a front surface;

a countersunk slot which is located in said front surface at said first end of said first shoulder element, said countersunk slot having a first end and a second end;

a first radial surface which is located at said first end of said countersunk slot;

a second radial surface which is located at said second end of said countersunk slot;

a bottom surface located between said first end and said second end of said countersunk slot, said bottom surface being perpendicular to said first and second radial surfaces of said countersunk slot;

a second shoulder element having a first end and a second end, a substantially middle region of said second shoulder element being located between said first end and said second end thereof, said substantially middle region having a hole located therein;

said second shoulder element having said first end terminating in a sliding tip, said sliding tip having mutually parallel surfaces which slidably fit into said mutually parallel surfaces of said slot;

wherein said sliding tip of said second shoulder element slides in relation to said slot of said first shoulder element from a first position to a second position responsive to deflection of said first and second tensioning elements mutually toward each other;

wherein said sliding tip of said second shoulder element rotates with respect to said slot of said first shoulder element at said second position responsive to continued deflection of said first and second tensioning elements mutually toward each other; and wherein said first distal tip of said first tensioning element is rotatably connected to said first shoulder element at said hole therein, said second distal tip of said second tensioning element is rotatably connected to said second shoulder element at said hole therein.

4. The garment hanger of claim 3, wherein said sliding tip having two radial surfaces which contact and rotate in relation to said second radial surface of said countersunk slot; and said sliding tip having two mating surfaces which are perpendicular to said two radial surfaces which engage said bottom surface of said countersunk slot, wherein said first shoulder element is retained in rotatable relationship to said second shoulder element.

* * * * *